United States Patent [19]

Camilleri

[11] 4,177,988

[45] Dec. 11, 1979

[54] PIN ORIENTATOR

[76] Inventor: Thomas M. Camilleri, 277 Avenue W, Brooklyn, N.Y. 11223

[21] Appl. No.: 860,578

[22] Filed: Dec. 14, 1977

Related U.S. Application Data

[63] Continuation-in-part of Ser. No. 781,571, Mar. 28, 1977, abandoned.

[51] Int. Cl.[2] ..... A63D 5/09

[52] U.S. Cl. ..... 273/43 D; 198/842

[58] Field of Search ..... 273/43 R, 43 A, 43 D; 198/813, 841, 842, 843

[56] References Cited

U.S. PATENT DOCUMENTS

| | | | |
|---|---|---|---|
| 2,693,269 | 11/1954 | Bentley | 198/842 |
| 2,767,983 | 10/1956 | Holloway et al. | 273/43 R |
| 2,767,984 | 10/1956 | Zuercher | 273/43 D |
| 3,248,108 | 4/1966 | Congelli et al. | 273/43 D |
| 3,648,825 | 3/1972 | Burstein | 198/842 X |
| 3,993,185 | 11/1976 | Fleckenstein et al. | 198/813 |

*Primary Examiner*—Anton O. Oechsle
*Attorney, Agent, or Firm*—Donald J. Perrella

[57] ABSTRACT

An automatic bowling machine is provided with means adapted to maintain the distributor belt closer than otherwise to the orientating pan.

9 Claims, 2 Drawing Figures

Fig.1.
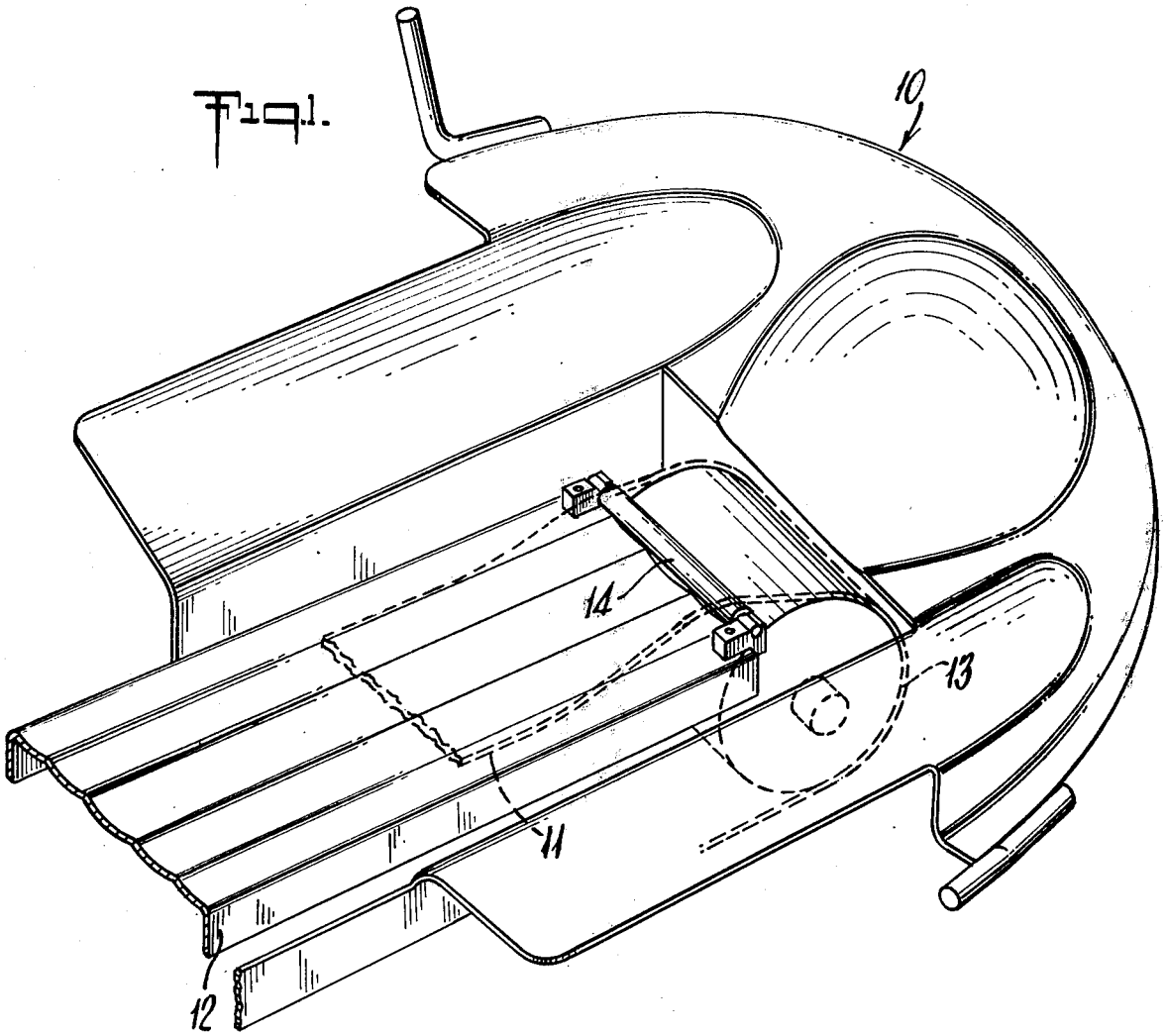
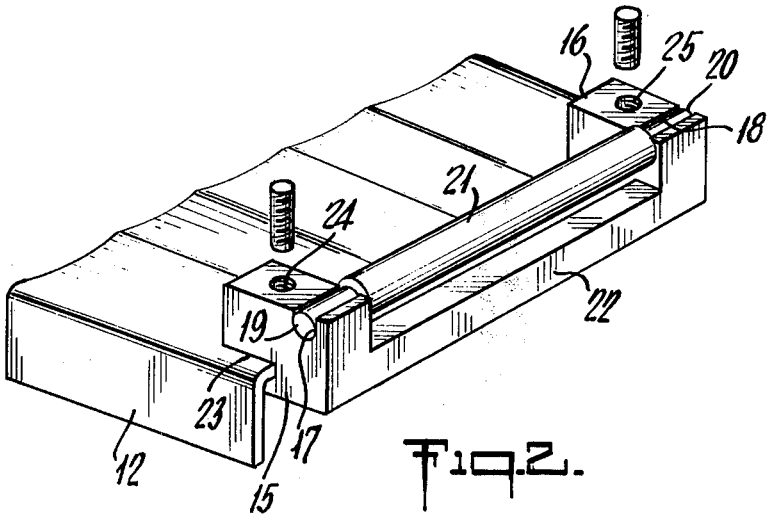
Fig.2.

PIN ORIENTATOR

RELATED APPLICATION

This application is a continuation-in-part of copending application Ser. No. 781,571 filed Mar. 28, 1977 now abandoned.

BACKGROUND OF THE INVENTION

In one type of automatic pinspotter bowling machine the pin wheel lifts the bowling pins to an orienting pan from which the pins slide onto a distributor belt which leads the pins to the respotting cups. A difficulty with this system is that a pin on the orienting pan may not make immediate contact with the distributor belt. When this happens the next pin may be pushed into the first one causing a pin jam resulting in improper placement of pins in the respotting cups. This situation requires manual correction and is an annoying inconvenience and delay to the bowlers.

OBJECTS OF THE INVENTION

It is an object of the present invention to provide means to insure that pins leaving the orientating pan immediately contact the distributor belt. Another object is to provide means to prevent pins coming off the orienting pan from jamming. These and other objects of the present invention will be apparent from the following description.

SUMMARY OF THE INVENTION

An automatic bowling machine is provided with means adapted to contact the bottom of the distributor belt to maintain the distributor belt closer than otherwise to the orientating pan.

BRIEF DESCRIPTION OF THE DRAWINGS

FIG. 1 is a perspective view of an automatic bowling pinspotter showing the orientating pan and distributor belt assembly.

FIG. 2 is a perspective view of the pin orientator.

DETAILED DESCRIPTION

The pin orientator of the present invention as shown in FIG. 1 forms part of the pin orientating pan and distributor belt assembly for an automatic pinspotter. In such pinspotting apparatus a pin wheel (not shown) receives the bowling pins that have been swept to the rear of the machine and raises them individually to an orientating pan 10 from which the pin is gravity fed to a distributor belt 11 which delivers the pin to the respotting cup (not shown). The distributor belt rides over a distributor belt runner 12 and is driven by a belt wheel 13. The pin orientator 14 of the present invention is attached to the end of the distributor belt runner and serves to bring the distributor belt in closer proximity than otherwise to the orientating pan so that a pin sliding off the pan makes immediate contact with the distributor belt.

The pin orientator as shown in FIG. 2 is formed of two side members 15 and 16 each of which has a substanially U-shaped recess 17 and 18, respectively. The recess receives the shaft ends 19 and 20 of roller 21 which contacts the underside of distributor belt 11 and raises the belt so that it comes into close proximity to pin orientating pan 10. Side member 15 is provided with mounting groove 23 which slides over the end of distributor belt runner 12. A similar mounting groove (not shown) is provided in side member 16. Side members 15 and 16 are joined by connecting member 22. Tap holes 24 and 25 in side members 15 and 16, respectively, receive set screws to lock the pin orientator 14 to the distributor belt runner 12.

While the pin orientator of the present invention has been described with reference to roller means, it is to be understood that other modifications may equally be employed, the essential feature being means adapted to contact the bottom of the distributor belt in order to maintain the belt closer than otherwise to the orientating pan. These means may comprise substantially linear contacting means, for instance, instead of roller means, there may be employed, e.g., rod means (not shown as obvious) or, e.g., bar means (not shown as obvious). It will also be understood that while roller means are preferred in order to minimize friction and wear, it is not essential that the means adapted to maintain the belt closer than otherwise to the orientating pan be adapted to rotate.

What is claimed is:

1. In an automatic pinspotter bowling machine having an orientating pan from which the pins slide onto a distributor belt having the top run thereof supported throughout a major portion of its length by a belt runner, the improvement comprising an orientator having means adapted to contact and raise the bottom of the top run of the distributor belt above the plane of the belt runner to maintain the distributor belt closer than otherwise to the orientating pan.

2. An orientator according to claim 1 wherein the means which contact the bottom of the distributor belt is supported from the belt runner.

3. An orientator according to claim 1 wherein the means are roller means.

4. An orientator according to claim 1 wherein the means are rod means.

5. An orientator according to claim 1 wherein the means are bar means.

6. An orientator according to claim 2 wherein the means is a substantially linear member, at least one end of the substantially linear member attached to a support means attached to the distributor belt runner.

7. An orientator according to claim 6 wherein the support means has a substantially U-shaped recess adpated to fit over an edge of the distributor belt runner.

8. An orientator according to claim 6 wherein the support member has means adapted to retain the end of the substantially linear member in the support member.

9. An orientator according to claim 6 wherein each end of the substantially linear member is attached to a support member having means adapted to retain that end of the substantially linear member in the support member, the support means having a substantially U-shaped recess adapted to fit over an edge of the distributor belt runner.

* * * * *